US005263853A

United States Patent [19]

Pall

[11] Patent Number: 5,263,853

[45] Date of Patent: Nov. 23, 1993

[54] SAFETY DEVICE FOR A SHOWER VALVE

[76] Inventor: Beth Pall, 73 Babylon Dr., Sound Beach, N.Y. 11789

[21] Appl. No.: 802,337

[22] Filed: Dec. 4, 1991

[51] Int. Cl.[5] ..... F16L 5/00

[52] U.S. Cl. ..... 137/382; 137/359; 137/360

[58] Field of Search ..... 137/382, 359, 360

[56] References Cited

U.S. PATENT DOCUMENTS

| | | | |
|---|---|---|---|
| 1,464,745 | 8/1923 | Campbell | 137/382 |
| 2,635,628 | 4/1953 | Stamper | 137/382 |
| 3,199,121 | 8/1965 | Greto | 137/382 |
| 4,301,828 | 11/1981 | Martin, Jr. | 137/382 |
| 4,678,003 | 7/1987 | Griffin | 137/382 |

*Primary Examiner*—A. Michael Chambers

*Attorney, Agent, or Firm*—Collard & Roe

[57] ABSTRACT

A faucet cover safety device for preventing the unintentional misadjustment of a single lever faucet handle mounted on a wall comprises a faucet escutcheon plate for location between the faucet handle and the wall. The faucet escutcheon plate has an external perimeter along which is located a catch; and the faucet escutcheon plate has a centrally located opening through which the faucet handle protrudes. A bowl-shaped cover for encloses the faucet handle, and a hinge for connecting the external perimeter to the bowl-shaped cover to the faucet escutcheon plate. The cover has a periphery along which is located a latch for mating engagement with the catch of the faucet escutcheon plate, for preventing the unintentional misadjustment of the faucet handle.

19 Claims, 6 Drawing Sheets

SAFETY DEVICE FOR A SHOWER VALVE

BACKGROUND OF THE INVENTION

1. Field of the Invention

The present invention relates to a removable locking cover for a shower or bath valve to prevent scalding, flooding or drowning of a child near the valve.

2. The Prior Art

It sometimes occurs that a child who is bathing in a bathtub may, through curiosity or inadvertence, turn on the hot water faucet and scald himself.

U.S. Pat. No. 2,853,714, to Darmstadt, discloses a bathtub cover to protect the fixtures and bathtub from damage, while the rest of the bathroom is constructed around it. The cover is not intended for use while bathing.

U.S. Pat. No. 3,199,121, to Greto, discloses a removable protective cover for water fixtures, which encloses several fixtures on a shower or bathtub wall to prevent forcible contact with the fixtures during bathing. The cover is provided with hand holes for access to the fixtures for adjustment thereof. The cover does not provide for a locking mechanism to prevent accidental turning on of the hot water fixtures.

SUMMARY OF THE INVENTION

It is an object of the present invention to provide a hinged protective cover for a faucet handle that has a locking mechanism to prevent accidental turning of the faucet handle by a child to prevent scalding, flooding or drowning of the child.

The above object is accomplished, according to the present invention, by providing a faucet cover safety device for preventing the unintentional misadjustment of one or more lever faucet handles mounted on a wall comprising: a faucet escutcheon plate for location between the faucet handle and the wall, the faucet face plate having an external perimeter along which is located a catch, the faucet face plate having a centrally located opening through which the faucet handle protrudes; a bowl-shaped cover for enclosing the faucet handle, and a hinge for connecting the external perimeter to the bowl-shaped cover to the faucet face plate; and the cover having a periphery along which is located a latch for mating engagement with the catch of the faucet face plate, for preventing the unintentional misadjustment of the faucet handle.

Generally speaking, the invention relates to a safety device for a shower valve which prevents the shower valve from being turned, once the safety device has been locked in place. The safety device includes a cover which has a hole into which the user reaches a releasable latch so that the cover can be opened to provide access to the shower valve. The safety device is intended primarily for small children who might be inclined to play with the shower valves while taking a bath or shower and risk being burned by sudden surges of hot water.

In one embodiment, the user closes a plastic bowl over the circumference of a frame so that a latch will snap into a catch and prevent the child from reaching the faucet handle to change the hot water position, thereby preventing the child from burning himself.

In another embodiment, a small finger hole can be made in the surface of the bowl cover, and a latch can be reached internally in the bowl so that only an adult person putting his finger through the opening and contacting the latch in this manner will be able to release the latch from the catch. A small child will not be able to figure out the design, or have a finger long enough to reach from the hole to the latch.

The use of an escutcheon and mounting screws are to anchor the safety device to the room wall.

In a further embodiment, one safety device may be utilized to cover two or more faucet handles simultaneously. Alternatively, one safety device may be used to cover each faucet handle, in a multiple group of faucet handles, so that two or more safety devices are employed at the same time.

In a further embodiment, it is possible to adjust the location of the latch relative to the opening in the cover in order to make reaching the latch more difficult for a child.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
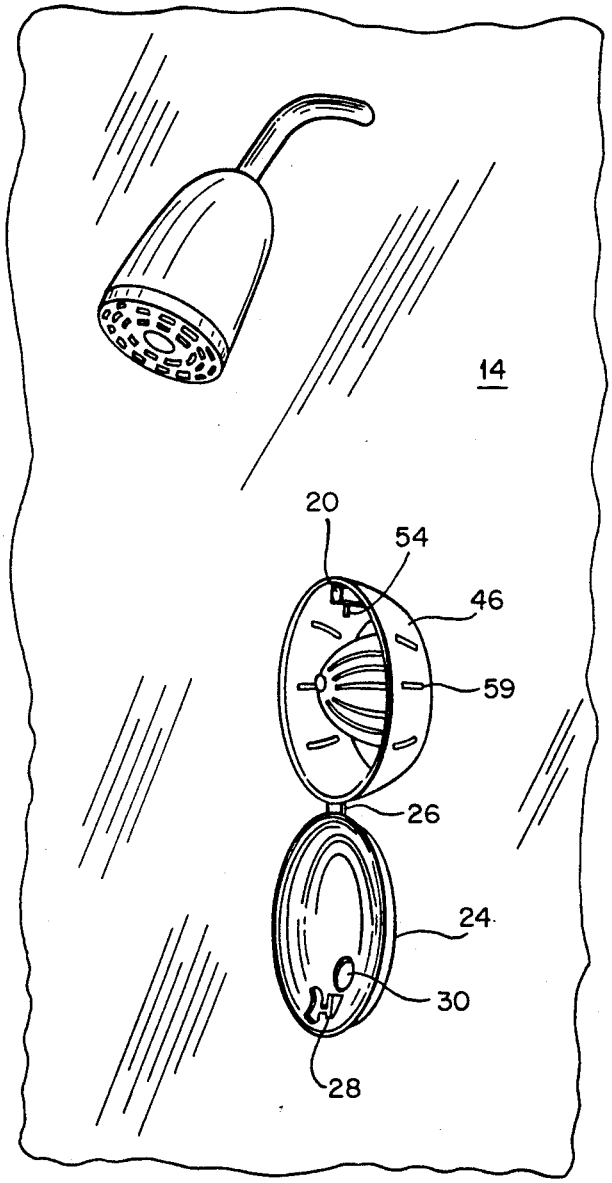
FIG. 1 is a perspective view of the safety device for a shower valve of the present invention.

Turning now in detail to the drawings, the faucet cover safety device 10, for preventing the unintentional misadjustment of at least one lever faucet handle 12 mounted on a wall 14, is shown in place for actual use in FIG. 1. There may be one or more, such as two or three, lever faucet handles in use. The safety device 10 includes a faucet escutcheon plate 16 for location between the faucet handle 12 and the wall 14. The faucet escutcheon plate 16 has an external perimeter 18, along which is located a catch 20. The faucet face plate has a centrally located opening 22, through which the faucet handle protrudes, as shown in FIGS. 1, 2 and 3.

Opening 22 can vary in diameter in order to accommodate one or more faucet handles or plumbing fixtures of various sizes or shapes. Also, it is possible to use a separate, individual safety device to cover each individual faucet handle of a multifaucet set, such as one safety device for the "hot" faucet handle and another safety device for the "cold" faucet handle.

Figure 2:
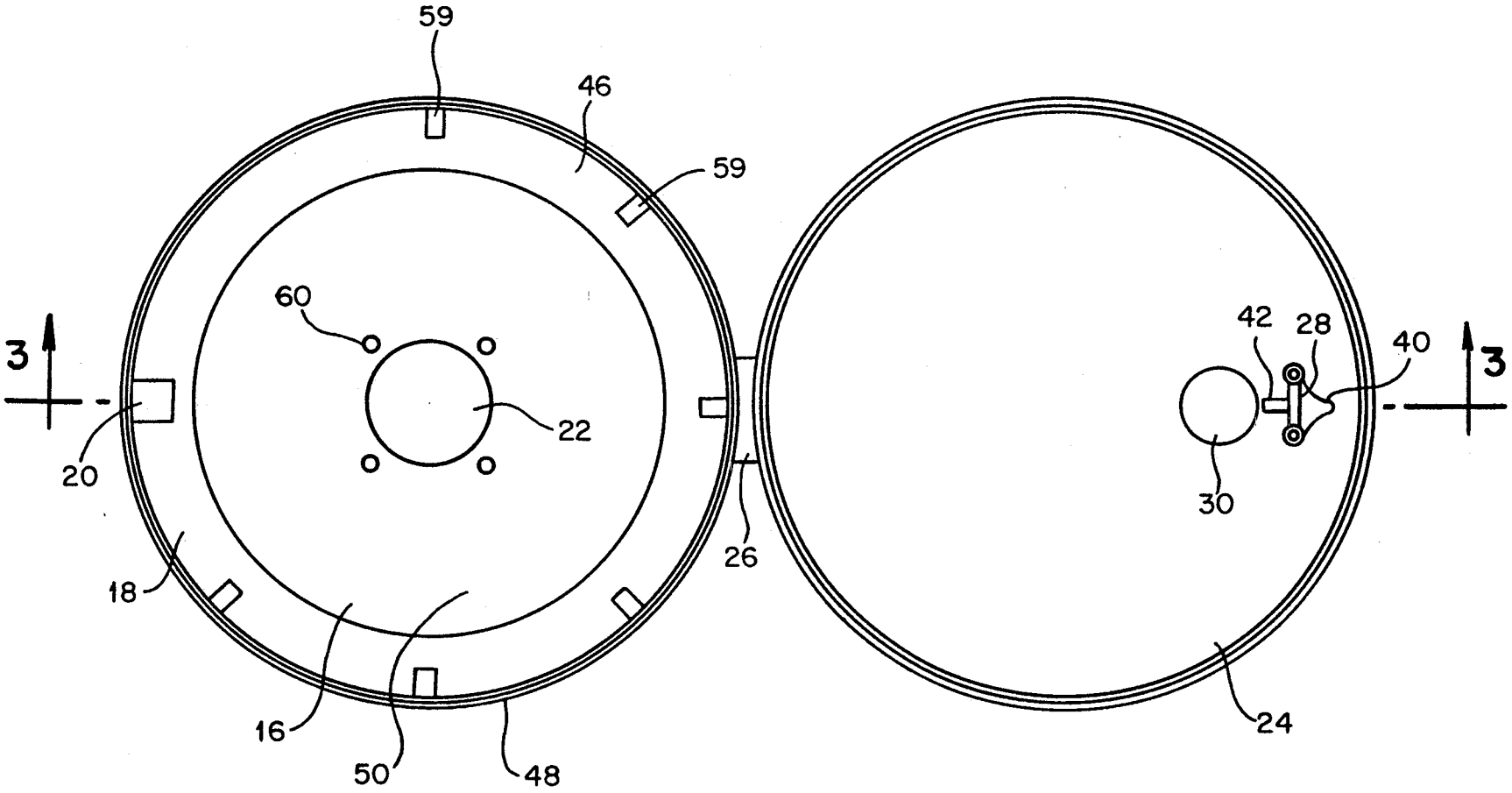
FIG. 2 is a top view of the safety device.
Figure 3:
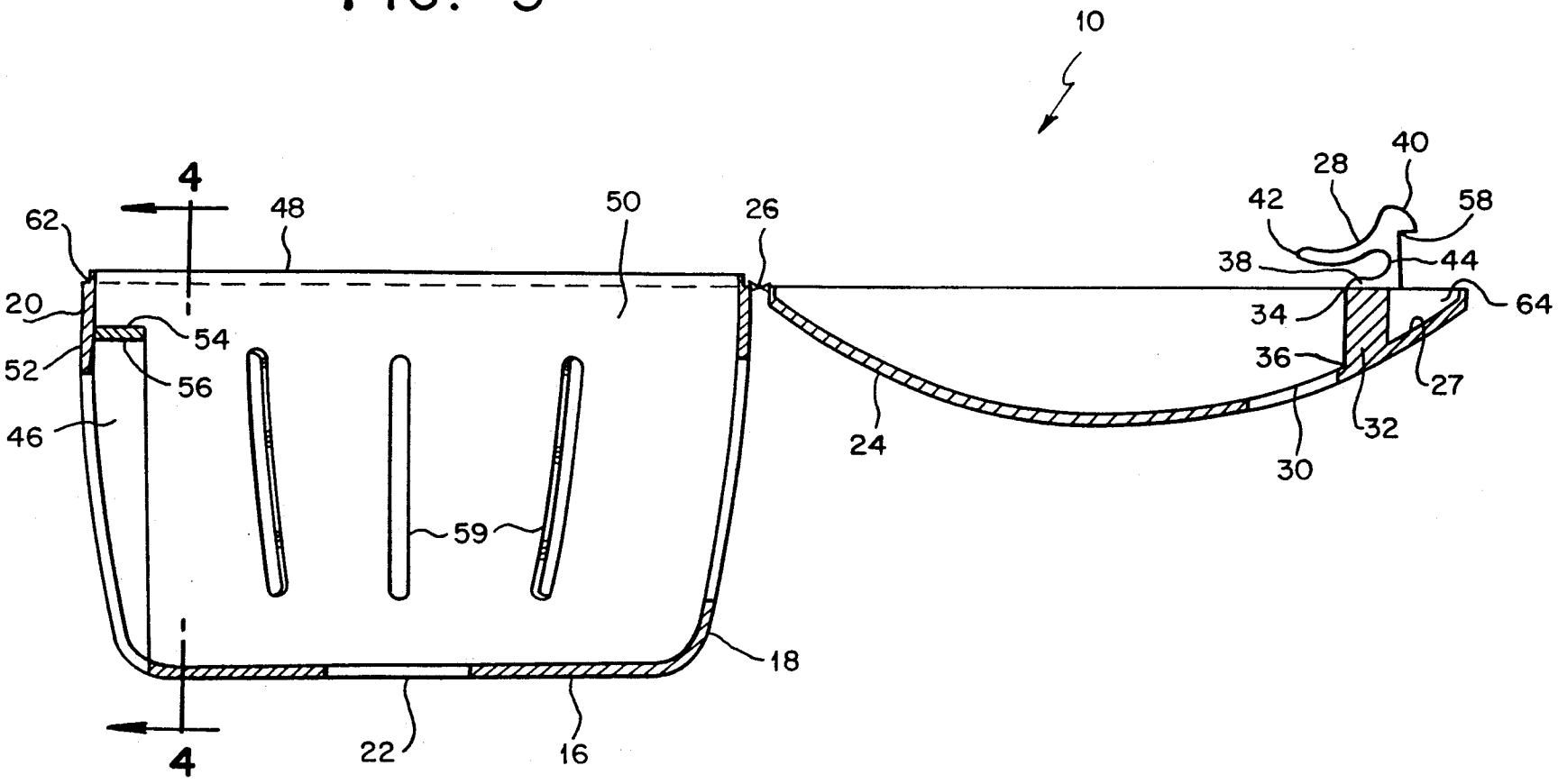
FIG. 3 is a section view of the safety device along line 3—3 of FIG. 2.

There is also a bowl-shaped cover 24 for enclosing the faucet handle 12, as seen in FIGS. 2 and 3. Also, a hinge 26 connects the external perimeter 18 to the bowl-shaped cover 24. This cover 24 has a periphery 27, along which is located a latch 28 for mating engagement with the catch 20 of the faucet plate 16, for preventing the unintentional misadjustment of the faucet handle 12.

There is an opening 30 in the cover 24 adjacent to the latch 28, and through this opening 30, the latch 28 is manipulatable in order to dislodge the latch 28 from mating engagement with the catch 20 of the faucet face plate 16.

Figure 5:
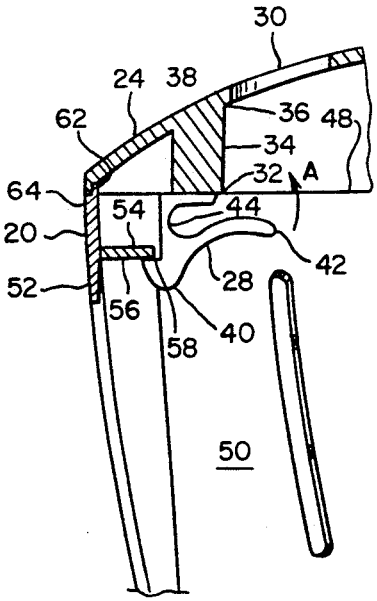
FIG. 5 is an enlarged view of the mating engagement of the latch with the catch.

The faucet cover safety device also includes a mounting means 32, as shown in FIG. 3 and in FIG. 5, having a first end 34 for attaching to the latch 28, and having a second end 36 for attaching to the cover 24.

As seen in FIGS. 3 and 5, the latch 28 includes a foot 38 for immovable attachment to the first end 34 of the mounting means 32 and includes a head 40 and an arm 42 a spaced distance from the foot 38. There is a neck 44 positioned between the foot and head, and the arm of the latch, for connecting the head and arm combination in a flexible, resilient movable manner to the immovable foot 38 of the latch.

The external perimeter 18 includes a sidewall 46 extending vertically upwardly from the faucet escutcheon plate 16 to define an open upper edge 48 for a housing 50 created therewithin the sidewall 46.

As seen in FIGS. 3 and 5, the catch 20 includes a vertical portion 52 attached to the sidewall 46 adjacent to the upper edge 48. Catch 20 includes a horizontal portion 54 connected to the vertical portion 52, with the horizontal portion 54 being a flat arm having an underside 56 to which the latch head 40 is releasably held by a flat nose 58 of the latch head 40 for mating engagement between the latch and the catch. This mating engagement occurs whenever the latch head 40 is placed in an inverted position with the flat nose 58 beneath and contacting the underside 56 of the flat arm 54, as specifically shown in FIG. 5.

Figure 4:
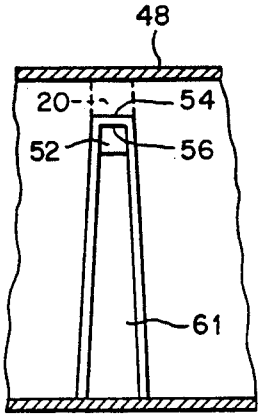
FIG. 4 is a partial section view of the safety device along line 4—4 of FIG. 3.

The safety device also includes longitudinally extending openings 59, as shown in FIGS. 2 and 3 in the sidewall 46, for permitting the escape of the gases and liquids, such as air, water or steam and soapy solutions, from the housing 50. Openings 59 may be of different sizes, but preferably are of the same size. Reinforcing rib 61 strengthens the wall supporting the catch 20, as shown in FIG. 4, since it is adjacent to catch 20.

The safety device further includes orifice means 60, as shown in FIG. 2, in the faucet escutcheon plate 16, through which fastener means (not shown) are inserted for attaching the device to the wall.

FIG. 5 shows the arrangement of the catch and the latch in mating engagement, wherein the cover has been closed over the housing, so as to prevent the unintentional misadjustment of the faucet handle. If it is desired to disengage the catch and the latch, an adult person would insert a finger through opening 30. Then by appropriately pulling upwardly (as indicated by arrow A) upon the arm 42 of the latch 28 causing a flexing of the neck 44, the flat nose 58 of the latch head 40 would no longer be contacting the underside 56 of the catch 20, enabling the adult to separate and disengage the cover 24 from the housing 50 and from the open upper edge 48 of the housing 50.

As shown in FIGS. 3 and 5, the upper edge 48 has a reverse L-shaped lip 62 for mating engagement with a correspondingly inverse L-shaped lip 64 of the cover 24.

Figure 6:
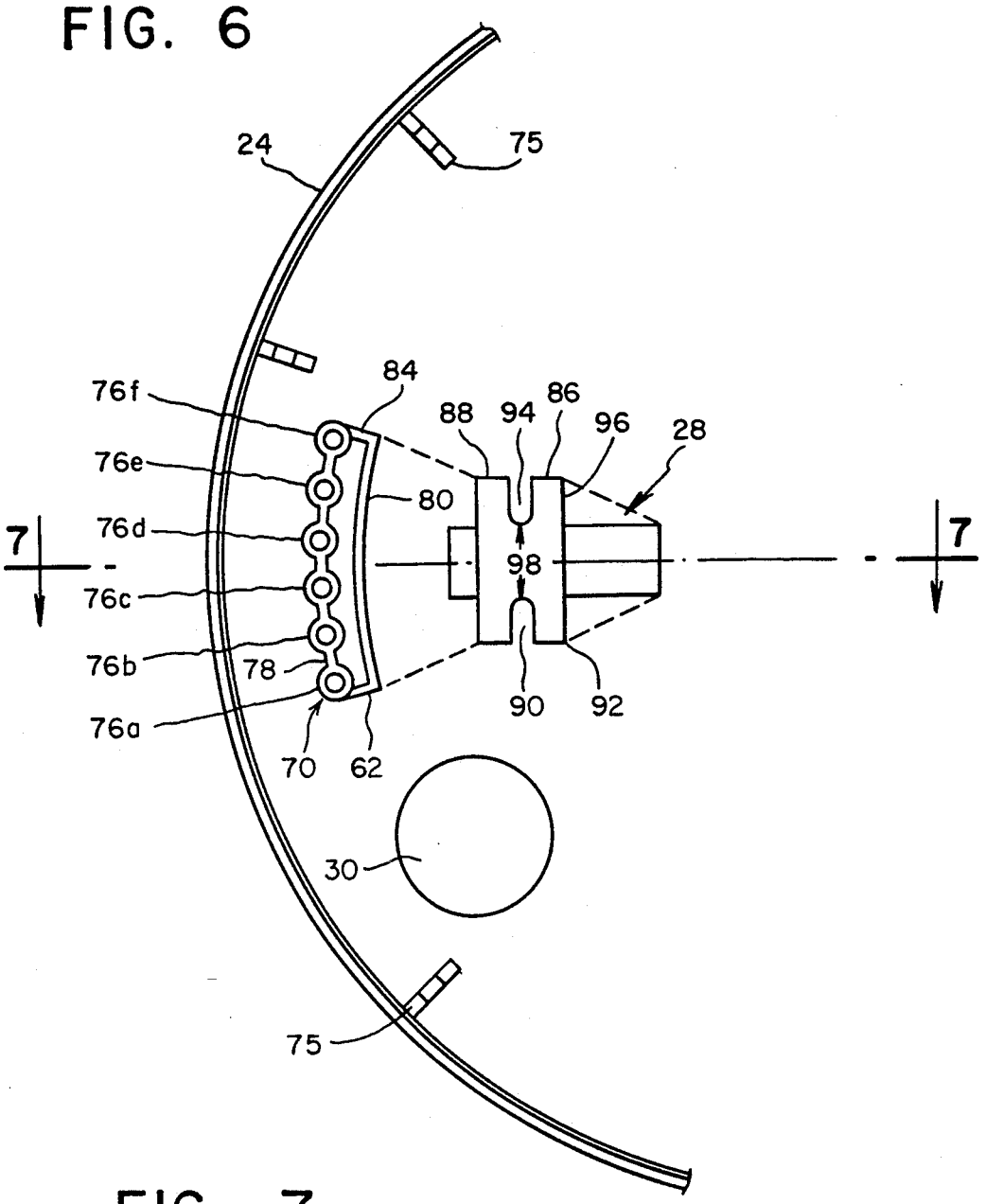
FIG. 6 is a partial view of the cover of the safety device showing another embodiment of the latch, with an exploded view of the latch above the mounting means.
Figure 7:
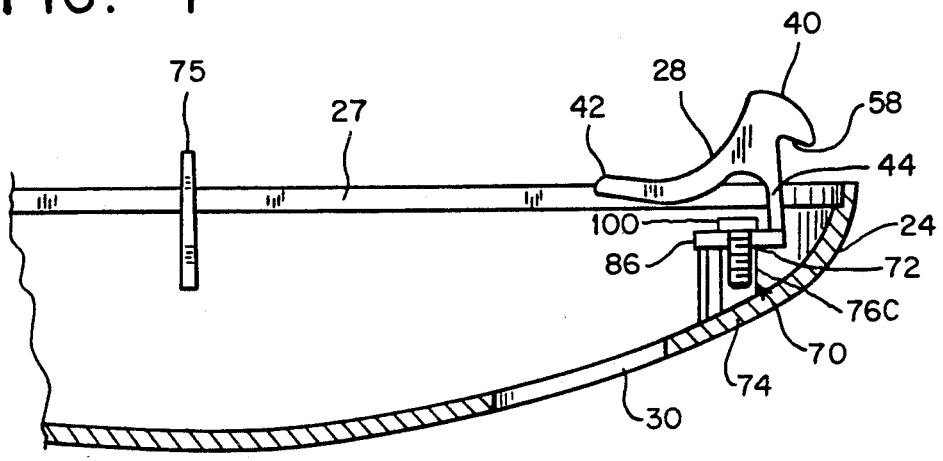
FIG. 7 is a partial section of the cover along lines 7—7 of FIG. 6.

Another embodiment according to the invention is shown in FIGS. 6–13 in which a modified version of the latch and a modified version of the catch are shown. As shown in FIGS. 6 and 7, the cover 24 has mounting means 70 which has a first end 72 for temporary releasable attachment to latch 28 and which has a second end 74 for permanent attachment to the cover 24. The mounting means first end 72 includes a series of arcuately aligned adjacent fastener receptacles **76*a*, 76*b*, 76*c*, 76*d*, 76*e*, and 76*f*, wherein the first receptacle 76*a*, and the last receptacle 76*f*, comprised end receptacles in the series. There is an interconnecting means 78 for connecting each fastener receptacle to an adjacent fastener receptacle. An arcuate support fence 80 is a spaced distance from, and parallel to, the aligned adjacent fastener receptacles. This fence 80 has a first arm 82 and a second arm 84. The first arm 82 attaches the fence to the first receptacle 76*a*, and the second arm 84 attaches the fence to the last receptacle 76*f***.

As shown in FIGS. 6 and 7, latch 28 includes a foot 86 for releasable and movable attachment to the first end 72 of the mounting means 70. FIG. 6 provides an exploded view of the latch above the mounting means. The latch also includes a head 40 and an arm 42 a spaced distance from the foot, with the head having a flat nose 58. There is a neck 44 positioned between the foot, head and arm for connecting the head and arm in a flexible, resilient, manner to the movable foot 86.

The movable foot 86 includes a flat platform 88 having a first opening 90 at one end 92 thereof and having a second opening 94 at another end 96 thereof, each of the first opening and the second opening being a laterally-positioned slot that is parallel to the series of arcuately aligned adjacent fastener receptacles 76. Each slot extends inwardly from its respective ends toward the other slot and terminates a spaced distance 98 from the other slot.

Hence, whenever the platform 88 is placed onto the series of receptacles 76, the first slot opening 92 exposes one receptacle so that a fastener 100 inserted thereinto will simultaneously connect this one end 92 of the platform 88 to the first receptacle. Whenever the platform 88 is placed onto the series of receptacles 76, the second slot opening 94 exposes another receptacle so that another fastener 100 inserted thereinto will simultaneously connect another end 96 of the platform 88 to another receptacle, whereby foot 86 is attached to first end 72 of the mounting means 70 at a first distance from the opening 30 in the cover 24. In addition, whenever the fasteners 100 are removed, the platform 88 is shiftable arcuately along the series of aligned fastener receptacles 76, so that the foot 86 is attachable to the first end 72 of mounting means 70 at a second distance from the opening 30, to make reaching the latch more difficult for a child from the opening 30 in the cover 24.

The platform 88 has a longitudinal axis 1 along which the slots 92 and 94 are located. The head and arm have a longitudinal axis L; the axis L is perpendicular to the axis 1. The arcuate support fence 80 stabilizes the latch against unwanted slippage movement along axis L or axis 1.

Figure 9:
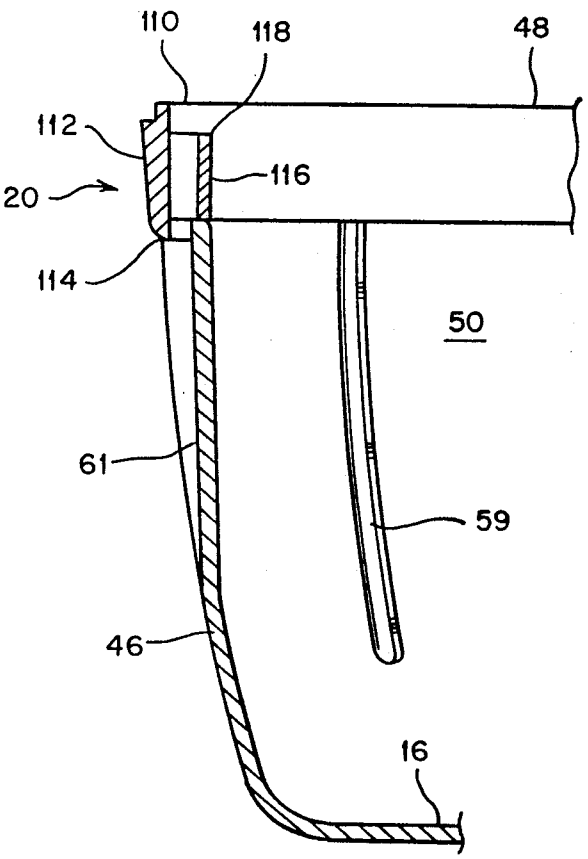
FIG. 9 shows a partial section view of the housing containing the additional embodiment of the catch as taken along line 9—9 of FIG. 8.
Figure 8:
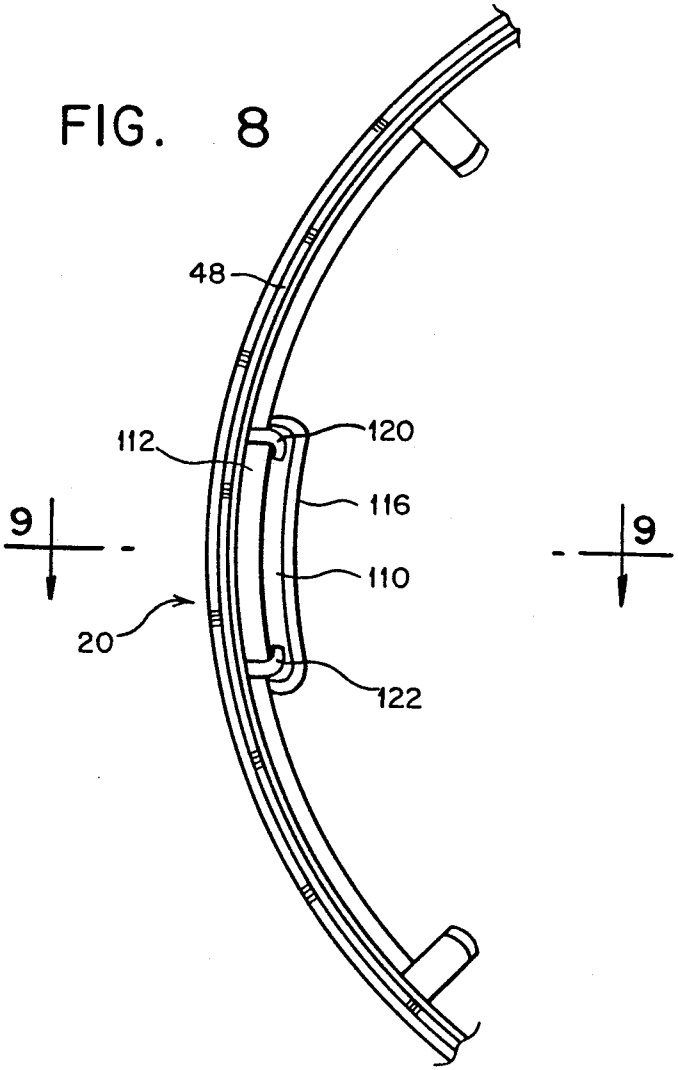
FIG. 8 is a partial top view of the housing showing another embodiment of the catch.

Referring now to FIGS. 8 and 9, the latch 20 in this embodiment includes a container chamber 110 having a back chamber wall 112 with a bottom retaining edge 114, a front chamber wall 116 having a top retaining edge 118, a right retainer rib 120, and a left retaining rib 122, with the container having an open top and an open bottom.

Figure 10:
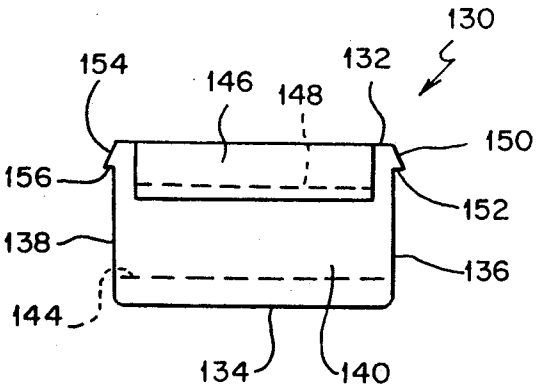
FIG. 10 shows the catch insert of the invention.
Figure 12:
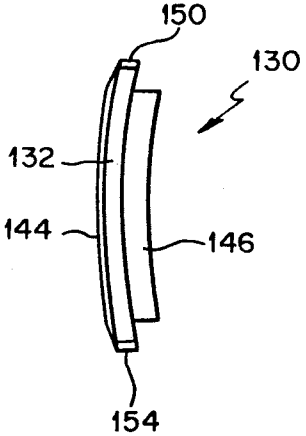
FIG. 12 is a top view of the catch insert of FIG. 11.
Figure 11:
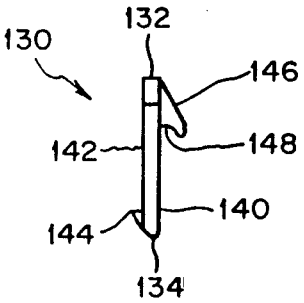
FIG. 11 shows a side view of the catch insert of FIG. 10.

The catch 20 additionally includes a catch insert 130 shown in FIGS. 10, 11 and 12. This catch insert has a top insert edge 132, a bottom insert edge 134, a right insert edge 136 connecting the top insert edge to the bottom insert edge, and having a left insert edge 138 connecting the top insert edge to the bottom insert edge. The catch insert also has a front surface 140 and a back surface 142. The catch insert 130 includes, in addition, an insert foot 144 attached to the back surface 142 and to the bottom insert edge and extends upwardly from the bottom insert edge 134 toward the top insert edge 132.

The catch insert 130 also includes an insert nose 146 attached to the front surface 140 and to the top insert edge and extends downwardly from the top insert edge 132 toward the bottom insert edge 134. The insert nose has a concave, downwardly-directed bottom cup 148.

The catch insert 130 also includes an insert right shoulder 150 located at the intersection of the top insert edge 132 and the right insert edge 136. The insert right shoulder slopes downwardly and outwardly to create a right shoulder ledge 152 therebeneath. There is an insert left shoulder 154 located at the intersection of the top insert edge 132 and the left insert edge 138. The insert left shoulder slopes downwardly and outwardly to create a left shoulder ledge 156 therebeneath.

The catch insert 130 is shown in FIG. 12 to be continuously, arcuately curved to correspond to the arcuate curvature of the open upper edge 48 of the housing 50, as seen in FIGS. 8 and 9.

The container chamber 110 and the catch insert 130 are so dimensioned that they are combinable into a snugly fitted together combination catch 20 which includes the following. The catch insert 130 is placed within the container chamber 110 with the catch insert back surface 142 adjacent to the back chamber wall 112; with the insert foot 144 beneath and adjacent to the chamber bottom retaining edge 114; with the insert nose cup 148 above and adjacent to the top retaining edge 118 of the front chamber wall 116; with the insert front surface 140 adjacent to the front chamber wall 116; with the insert right edge 136 adjacent to the chamber right retaining rib 120 and with the insert right shoulder ledge 152 above and adjacent to, and resting upon, the chamber right retaining rib 120; and with the insert left edge 138 adjacent to the chamber left retaining rib 122 and with the insert left shoulder ledge 156 above and adjacent to, and resting upon, the chamber left retaining rib 122.

Figure 13:
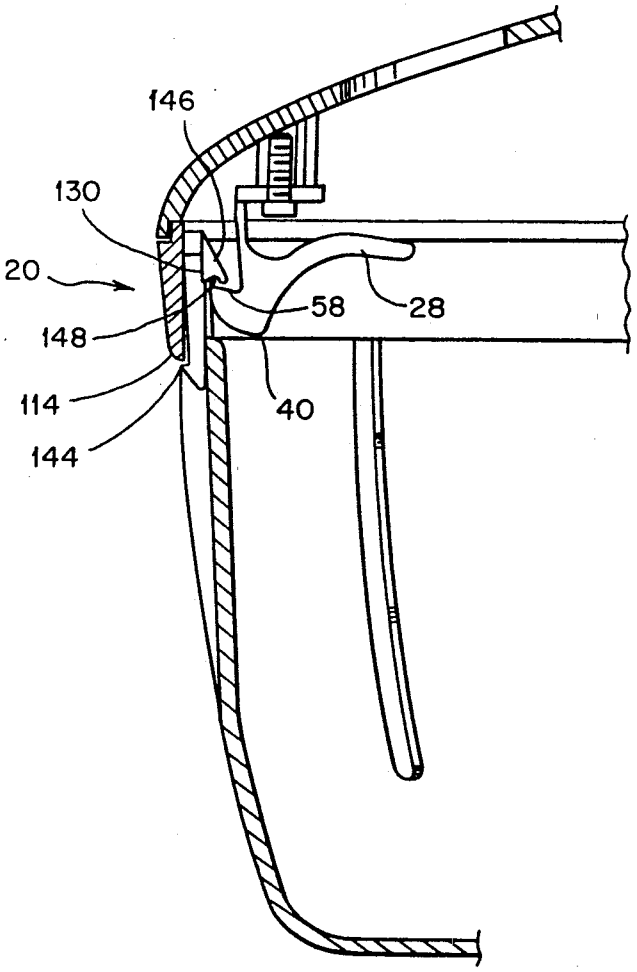
FIG. 13 is an enlarged view of the mating engagement of the latch with the catch based upon the additional embodiment of FIGS. 6 to 12.

Hence, the insert is locked into place as shown in FIG. 13 and prevented from downward movement by the retaining ribs 120 and 122, from upward movement by the bottom retaining edge 114, from rearward movement by the back chamber wall 112; and from forward movement by the front chamber wall 116.

As shown in FIGS. 6 and 7, there is a reinforcing fin 75 for stabilizing the periphery 27 of the cover 24.

As seen in FIG. 13, the catch insert downwardly extending nose 146 has a bottom cup 148 to which the latch head 40 is releasably held by the flat nose 58 of the latch head 40 for the mating engagement between the latch 28 and the catch 20, whenever the latch head 40 is placed in an inverted position with the flat nose 58 beneath and contacting the bottom cup 148 of the downwardly extending nose.

The safety device of the invention is installed by placing opening 22 of faucet escutcheon 16 over faucet handle 12, so that faucet handle 12 protrudes into housing 50. Then screw means are inserted through orifices 60 and are screwed into wall 14.

In one embodiment of the safety device, when in operation, the user closes the plastic bowl 24 over the circumference of the housing 50 so that the latch 28 will snap into the catch 20 for the mating engagement thereof, and prevent the child from reaching the faucet to change the hot water position, thereby preventing the child from burning himself. In order to open the safety device, the frictional force holding together the latch and the catch will be too great to be overcome by a child, but will not be so great that an adult would be unable to dislodge the latch from the catch.

In another embodiment, a small finger opening 30 can be made in the surface of the cover 24, and the latch 28 will be within reach of the opening so that only an adult person putting his finger through this opening and contacting the latch will be able to release the latch from the catch 20. A small child will not be able to figure out the design, or have a finger long enough to reach from the opening to the latch.

In a further embodiment, the latch can be shifted further away from the opening to make it less accessible to manipulation by a child.

The safety device may be constructed of plastic, such as polyethylene, polypropylene or polyvinyl chloride, or may be constructed of metal such as aluminum, or may be constructed of a combination of both plastic and metal.

While several embodiments of the present invention have been shown and described, it is to be understood that many changes and modifications may be made thereunto, without departing from the spirit and scope of the invention as defined in the appended claims.

What is claimed is:

1. A faucet cover safety device for preventing the unintentional misadjustment of at least one lever faucet handle mounted on a wall comprising:

a faucet escutcheon plate for location between said faucet handle and said wall, said faucet escutcheon plate having an external perimeter with an internal surface along which is located a catch, said faucet escutcheon plate having a centrally located opening through which said faucet handle is protrudable;

a bowl-shaped cover for enclosing said faucet handle, and a hinge for connecting said external perimeter to said bowl-shaped cover; and said cover having a periphery with an inner surface along which is located a latch for mating engagement with said catch of said faucet escutcheon plate, said mating engagement occurring within said safety device, for preventing the unintentional misadjustment of said faucet handle.

2. The faucet cover safety device of claim 1, further comprising:

an opening in said cover adjacent to said latch and through said opening, said latch being manipulatable in order to dislodge said latch from said mating engagement with said catch of the faucet escutcheon plate external perimeter.

3. The faucet cover safety device of claim 1, further comprising:

a mounting means having a first end for attaching to said latch and having a second end for attaching to said cover.

4. The faucet cover safety device of claim 3, wherein said latch comprises:

a foot for immovable attachment to said first end of said mounting means;

a head and arm a spaced distance from said foot, said head having a flat nose; and a neck positioned between said foot and said head and arm for connecting said head and arm in a flexible resilient movable manner to said immovable foot.

5. The faucet cover safety device of claim 1, wherein said external perimeter comprises a sidewall extending vertically upwardly from said faucet escutcheon plate to define an open upper edge for a housing created therewithin the sidewall.

6. The faucet cover safety device of claim 5, wherein said catch comprises a vertical portion attached to said sidewall adjacent to said upper edge; and a horizontal portion connected to said vertical portion, said horizontal portion being a flat arm having an underside to which said latch head is releasably held by the flat nose of said latch head for the mating engagement between said latch and said catch, whenever said latch head is placed in an inverted position with said flat nose beneath and contacting said underside of said flat arm.

7. The faucet cover safety device of claim 5, further comprising longitudinally extending openings in said sidewall for permitting the escape of gases and liquids from said housing.

8. The faucet cover safety device of claim 1, further comprising orifice means in said faucet face plate through which fastener means are inserted for attaching said device to said wall.

9. The faucet cover safety device of claim 2, further comprising:

a mounting means having a first end for temporary releasable attachment to said latch and having a second end for permanent attachment to said cover.

10. The faucet cover safety device of claim 9, wherein said mounting means first end comprises a series of arcuately aligned adjacent fastener receptacles comprising a first receptacle and a last receptacle in a series;

interconnecting means for connecting each fastener receptacle to an adjacent fastener receptacle;

an arcuate support fence a spaced distance from and parallel to said aligned adjacent fastener receptacles;

said fence having a first arm and a second arm;

said first arm attaching said fence to said first receptacle and said second arm attaching said fence to said last receptacle.

11. The faucet cover safety device of claim 10, wherein said latch comprises:

a movable foot for releasable attachment to said first end of said mounting means;

a head and arm a spaced distance from said foot, said head having a flat nose; and a neck positioned between said foot and said head and arm for connecting said head and arm in a flexible, resilient, movable manner to said movable foot.

12. The faucet cover safety device of claim 11, wherein said movable foot or said latch comprises a flat platform having a first opening at one end and having a second opening at another end thereof;

each of said first opening and said second opening being a laterally positioned slot that is parallel to said series of arcuately aligned adjacent fastener receptacles; each slot extending inwardly from its respective end toward the other slot and terminating a spaced distance from the other slot;

such that whenever said platform is placed onto said series of receptacles said first slot opening exposes one receptacle so that a fastener inserted thereinto will simultaneously connect said one end of said platform to said first receptacle;

whenever said platform is placed onto said series of receptacles said second slot opening exposes another receptacle so that another fastener inserted thereinto will simultaneously connect said another end of said platform to said another receptacle;

whereby said foot is attached to said first end of said mounting means a first distance from said opening in the cover; and such that whenever said fasteners are removed, said platform is shiftable arcuately along said series of aligned fastener receptacles so that said foot is attachable to said first end of said mounting means a second distance from said opening to make reaching said latch more difficult from said opening in the cover.

13. The faucet cover safety device of claim 12, wherein the platform of said latch has a longitudinal axis 1 along which said slots are located;

wherein the head and arm of said latch have a longitudinal axis L;

wherein axis L is perpendicular to axis 1; and wherein said arcuate support fence stabilizes the latch against unwanted slippage movement along axis L or axis 1.

14. The faucet cover safety device of claim 13, wherein said catch comprises a container chamber attached to said housing sidewall adjacent to said upper edge; and said container chamber having a back chamber wall with a bottom retaining edge, a front chamber wall having a top retaining edge, a right retaining rib, a left retaining rib, said container having an open top and an open bottom.

15. The faucet cover safety device of claim 14, wherein said catch further comprises a catch insert having a top insert edge, and a bottom insert edge;

a right insert edge connecting said top insert edge to said bottom insert edge;

a left insert edge connecting said top insert edge to said bottom insert edge; said catch insert having a front surface and a back surface;

said catch insert comprising an insert foot attached to said back surface and to said bottom insert edge and extending upwardly from said bottom insert edge toward said top insert edge;

an insert nose attached to said front surface and to said top insert edge and extending downwardly from said top insert edge toward said bottom insert edge; said insert nose having a concave downwardly directed bottom cup;

an insert right shoulder located at the intersection of the top insert edge and the right insert edge, and said insert right shoulder sloping downwardly and outwardly to create a right shoulder ledge therebeneath; and an insert left shoulder located at the intersection of the top insert edge and the left insert edge, and said insert left shoulder sloping downwardly and outwardly to create a left shoulder ledge therebeneath.

16. The faucet cover safety device of claim 15, wherein said catch insert is continuously arcuately curved to correspond to the arcuate curvature of the open upper edge of the housing.

17. The faucet cover safety device of claim 16, wherein said container chamber and said catch insert are so dimensioned that they are combinable into a snugly fitted together combination catch comprising:

said catch insert placed within said container chamber with said catch insert back surface adjacent to said back chamber wall, with said insert foot beneath and adjacent to said chamber bottom retaining edge, with said insert nose cup above and adjacent to said top retaining edge of said front chamber wall, with said insert front surface adjacent to said front chamber wall, with said insert right edge adjacent to said chamber right retaining rib and with said insert right shoulder ledge above and adjacent to, and resting upon, said chamber right retaining rib, and with said insert left edge adjacent to said chamber left retaining rib, and with said insert left shoulder ledge above and adjacent to, and resting upon, said chamber left retaining rib;

whereby said insert is locked into place and prevented from downward movement by said right and left retaining ribs, from upward movement by said bottom retaining edge, from rearward movement by said back chamber wall, and from forward movement by said front chamber wall.

18. The faucet cover safety device of claim 15, wherein the catch insert downwardly extending nose has a bottom cup to which said latch head is releasably held by the flat nose of said latch head for the mating engagement between said latch and said catch, whenever said latch head is placed in an inverted position with said flat nose beneath and contacting said bottom cup of said downwardly extending nose.

19. The faucet cover safety device of claim 1, further comprising a reinforcing fin for stabilizing the periphery of the cover.

* * * * *